US006212814B1

(12) United States Patent
Lambie

(10) Patent No.: US 6,212,814 B1
(45) Date of Patent: Apr. 10, 2001

(54) RECEIVER FOR FIREARM

(76) Inventor: Michael G. Lambie, 22 Chinook St., Pulaski, NY (US) 13142

( * ) Notice: Subject to any disclaimer, the term of this patent is extended or adjusted under 35 U.S.C. 154(b) by 0 days.

(21) Appl. No.: 09/416,797

(22) Filed: Oct. 13, 1999

(51) Int. Cl.[7] ..... F41C 23/12
(52) U.S. Cl. ..... 42/75.03
(58) Field of Search ..... 42/18, 21, 60, 42/70.1, 70.2, 75.02, 75.03; 89/128, 139, 33.1

(56) References Cited

U.S. PATENT DOCUMENTS

| | | | | |
|---|---|---|---|---|
| 4,602,450 | * | 7/1986 | Hoenig | 42/75.02 |
| 4,653,760 | * | 3/1987 | Dyer et al. | 273/310 |
| 4,914,845 | * | 4/1990 | Reese et al. | 42/40 |
| 5,452,534 | | 9/1995 | Lambie | 42/18 |
| 5,732,498 | * | 3/1998 | Arreguin | 42/70.11 |
| 6,052,934 | * | 4/2000 | Carpenter | 42/70.11 |

FOREIGN PATENT DOCUMENTS

0174901 * 3/1986 (EP) ..... F41C/11/06

* cited by examiner

*Primary Examiner*—Michael J. Carone
*Assistant Examiner*—J. Richardson
(74) *Attorney, Agent, or Firm*—Wall Marjama & Bilinski

(57) ABSTRACT

Apparatus for converting a semi-automatic weapon into a single shot weapon. In one embodiment, the lower receiver of the weapon is replaced by a lower receiver that has no magazine well. The replacement receiver contains a loading block that can be loaded through the ejection chamber of the weapon. A spring biased plunger is provided in the replacement receiver for moving the bolt catch into a holding position when the bolt is moved into a battery position. In a second embodiment of the invention a dummy magazine is permanently secured in the magazine well and contains a loading block that can be loaded with a cartridge through the ejection port of the weapon. A spring biased plunger is mounted in the dummy magazine behind the loading block that is arranged to bias the bolt catch of the weapon into a bolt retaining position when the bolt is in a battery position.

9 Claims, 3 Drawing Sheets

RECEIVER FOR FIREARM

BACKGROUND OF THE INVENTION

This invention relates to apparatus for removing the magazine well from a semi-automatic weapon and providing the weapon with a single shot loading capability.

Semi-automatic firearms capable of firing a large number of rounds in a short period of time are readily available at affordable prices to the general public. Misuse of these rapid fire weapons, however, is of growing concern, particularly among law enforcement people. Most semi-automatic weapons can accept magazines holding twenty or more rounds, thus providing law breakers, terrorists and the like with unprecedented firepower. Attempts are presently being made to make the use of detachable magazines in association with this type of weapon illegal.

Many of these semi-automatic weapons are sold to sportsmen for hunting or target shooting purposes and accordingly there is no need for a large detachable magazine. No one to date, however, has attempted to remove the magazine well from a semi automatic weapon and allow for single shot operation of these potentially dangerous weapons.

SUMMARY OF THE INVENTION

It is therefore an object of the present invention to eliminate the magazine well of a semi-automatic weapon and make it impractical to reconvert the weapon to accept a a detachable magazine.

It is a further object of the present invention to eliminate the high capacity firepower of a semi-automatic weapon.

A still further object of the present invention is to eliminate magazine feeding of a semi-automatic weapon and replace it with manual reloading capability, without adversely effecting the automatic ejection operation of the weapon.

It is a further object of the present invention to provide a retrofit unit for an automatic weapon which converts the weapon to single shot use.

It is a further object of the present invention to provide an apparatus that can be easily installed into the receiver of an existing semi-automatic weapon that will eliminate the magazine well and limit the receiver to single shot use.

These and other objects of the present invention are attained by apparatus for retrofitting a semi-automatic weapon of the type equipped with a detachable magazine for bringing cartridges one at a time into the receiver of the weapon where the cartridges are fed into the barrel chamber by a bolt. The receiver of most automatic weapons includes an upper section that is a permanent part of the weapon and a lower section that is adapted to receive the magazine and which can be removed from the weapon.

One form of the invention involves a replacement for the removable lower receiver section of the weapon that converts the weapon from a semi-automatic weapon to a hand loaded single shot weapon suitable for use as a target rifle or for varmint hunting where a single shot is all that is generally required. A second form of the invention involves a magazine that can be permanently secured in the magazine of the weapon. The magazine is equipped with apparatus for converting the weapon from a magazine weapon to a single shot weapon.

BRIEF DESCRIPTION OF THE DRAWINGS

For a better understanding of these and other objects of the present invention, reference will be made to the detailed description of the present invention which is to be read in association with the accompanying drawings, wherein.

DESCRIPTION OF THE INVENTION

Figure 1:
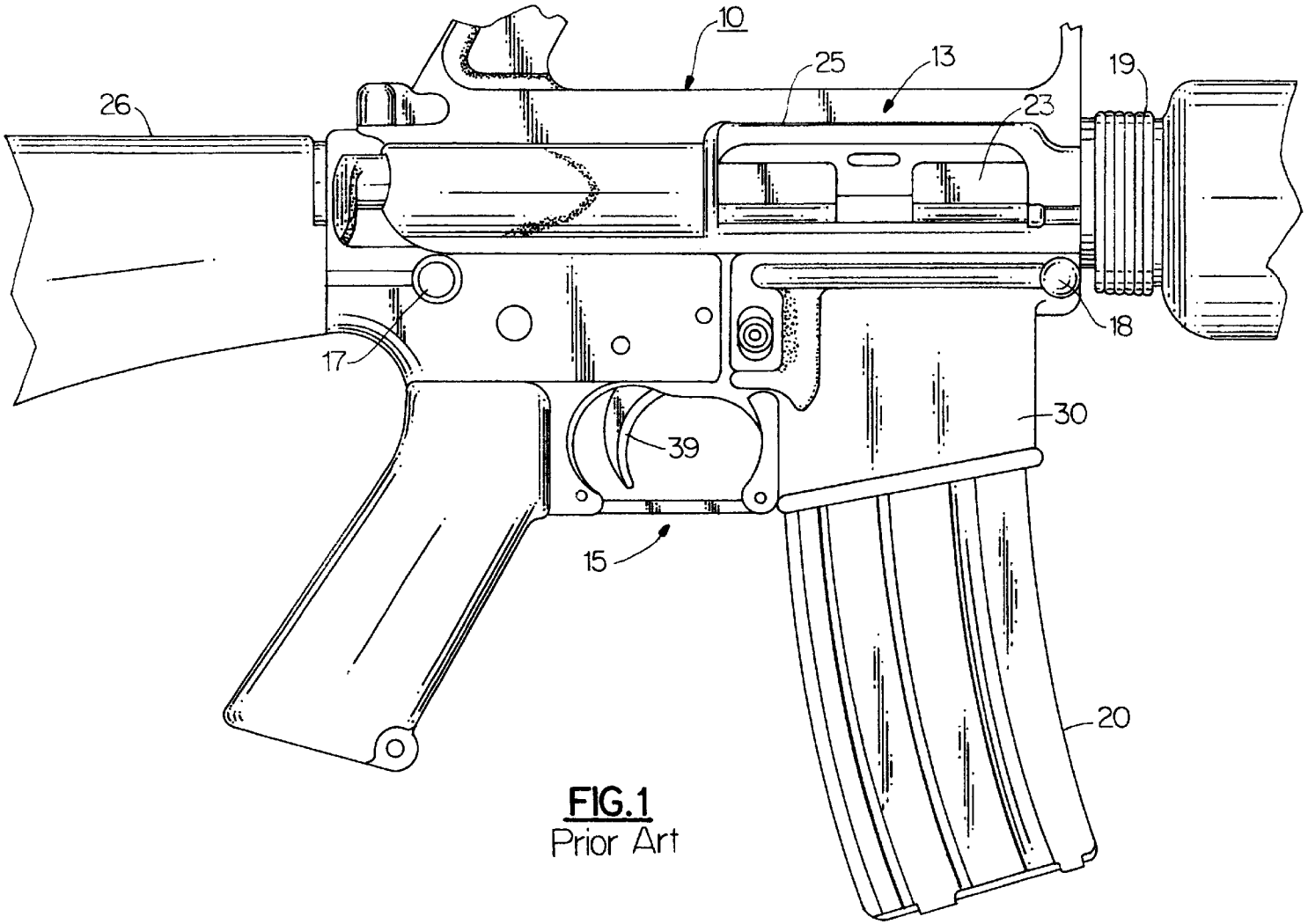
FIG.1 Prior Art
FIG. 1 is a partial side elevation of a prior art automatic weapon illustrating a typical receiver capable of accepting a high capacity magazine.

Referring now to the drawings, FIG. 1 illustrates a semi-automatic gas operated rifle, generally referenced 10, which is well known in the art and which is further described in detail in U.S. Pat. No. 5,452,534 to Lambie, the disclosure of which is incorporated herein by reference. The rifle is arranged to fire from a closed bolt position and includes a receiver 10 that contains an upper section 13 and a lower section 15. The lower receiver section is removably connected to the upper receiver section by a takedown pin 17 and a hinge pin 18. Removal of the pins allows the entire lower receiver section to be completely separated from the remainder of the weapon. As will be described in greater detail below, the lower receiver section is easily replaced with a modified lower section embodying the teachings of the present invention and which will in no way effect the operation of the upper receiver section or the remainder of the weapon.

The prior art weapon includes a barrel 19 that is attached to the front of the upper receiver section by hinge pin 18 and which contains a chamber that opens to the receiver for accepting a cartridge fed from a magazine 20. The cartridges contained in the magazine are fed in a well known manner one at a time from the magazine into the chamber by a slide bolt mechanism 23. The weapon is fired by pulling the trigger 39 releasing a firing pin in the forward section of the bolt which, in turn, strikes the cartridges igniting the power contained therein propelling the bullet out of the barrel toward the target. After firing, the bolt is urged back from the firing position to a battery position and the spent cartridge shell is ejected from the weapon through the ejection port 25. The bolt is then moved forward by a battery spring (not shown) stored within the stock 26 immediately behind the bolt.

A magazine well 30 is located in the forward part of the lower receiver and is adapted to slidably receive a magazine therein. To load the weapon, the magazine is moved upwardly into the well and is locked in place by a latching mechanism (not shown). Cartridges from the magazine are fed one at a time into the rifle breech where the bolt can pick up each cartridge and move it into the rifle barrel chamber. To remove the magazine from the well, a latch release found on the back side of the lower receiver is depressed which frees the magazine from the latching mechanism whereupon the magazine can be easily pulled from the well.

Most semi-automatic rifles of this type can accept magazines capable of storing more than twenty cartridges. This is far more than needed by a target shooter or varmint hunter. As noted above, semi-automatic weapons with this type of shell capacity are of little or no use to the average recreational shooter and in fact, pose a danger to the community if they find their way into the wrong hands. As will be explained below the present invention will allow potentially dangerous semi-automatic weapons to be quickly and easily modified so that they can be safely hand-loaded to fire one cartridge at a time and thus preserving the usefulness of the weapon while eliminating its potential danger.

Figure 2:
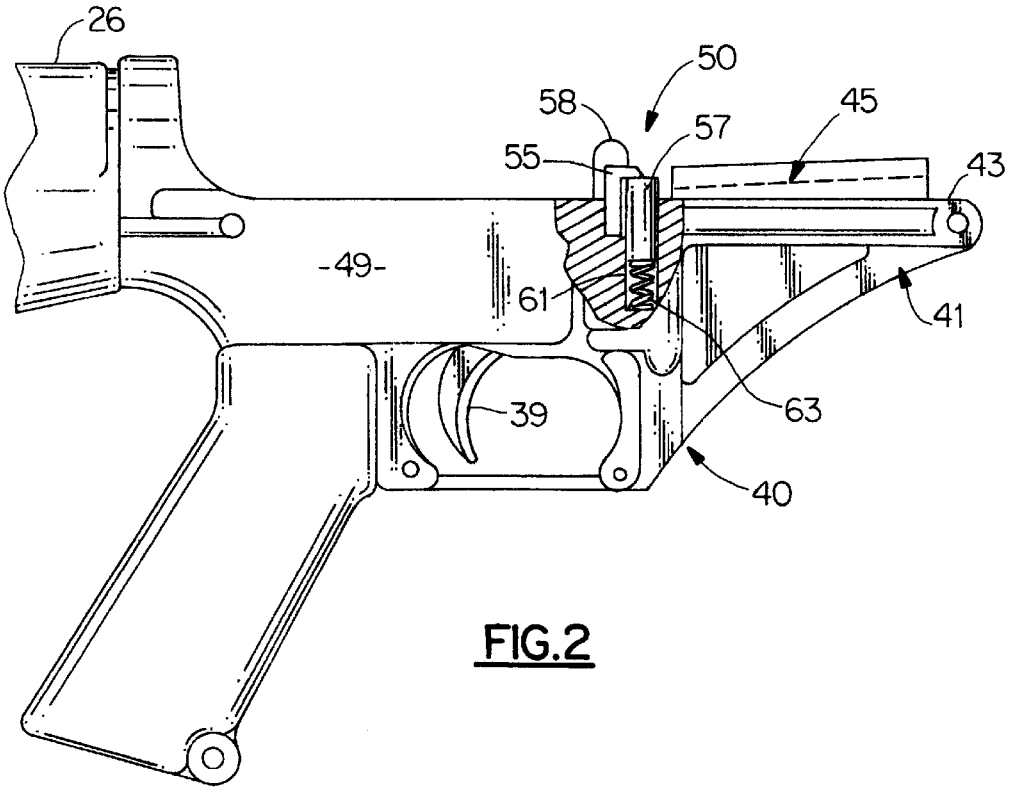
FIG. 2 is a partial front elevation with portions broken away of a modified weapon similar to that shown in FIG. 1 embodying the teachings of the present invention.
Figure 3:
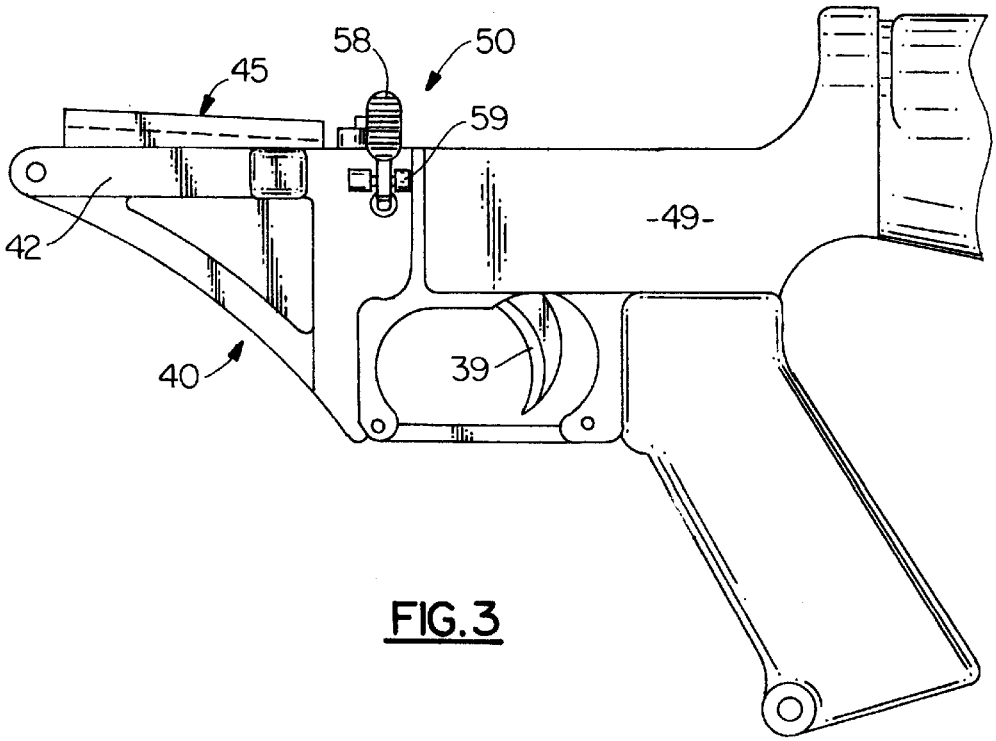
FIG. 3 is a partial rear elevation of the modified weapon embodying the teachings of the present invention.

The apparatus of the present invention will be explained in greater detail with reference to FIGS. 2–5 wherein like numbers are used to identify like parts as described above in regard to FIG. 1. The lower receiver of the weapon is removed as noted above by removing pins 17 and 18 and replaced by lower receiver 40 which is illustrated in FIGS. 2 and 3 attached to the stock 26 of the weapon. The lower receiver 40 operates in the same manner as the part that it has replaced except it must be loaded one cartridge at a time and the magazine well has been eliminated. The replacement section contains a trigger 39 that is adapted to coact with the bolt 23 to fire a cartridge when the bolt is in a closed or firing position.

The lower receiver section 40 contains a forward nose section 41 having a flat upper surface 43. A loading block 45 is secured to the upper surface by countersunk screws 46 so that various configured blocks can be mounted on the lower receiver to accommodate cartridges of differing sizes and shapes. The top of the block contains a concave cradle 47 that provides a seat for a cartridge. The loading block is formed of a lubricious material to permit a cartridge seated thereon to slide easily into the rifle chamber. The cradle is aligned with the central axis of the barrel and is inclined at a shallow angle as shown so that a cartridge mounted upon the block moves upwardly into the barrel chamber as the bolt is moved from the battery position to the firing position.

Figure 4:
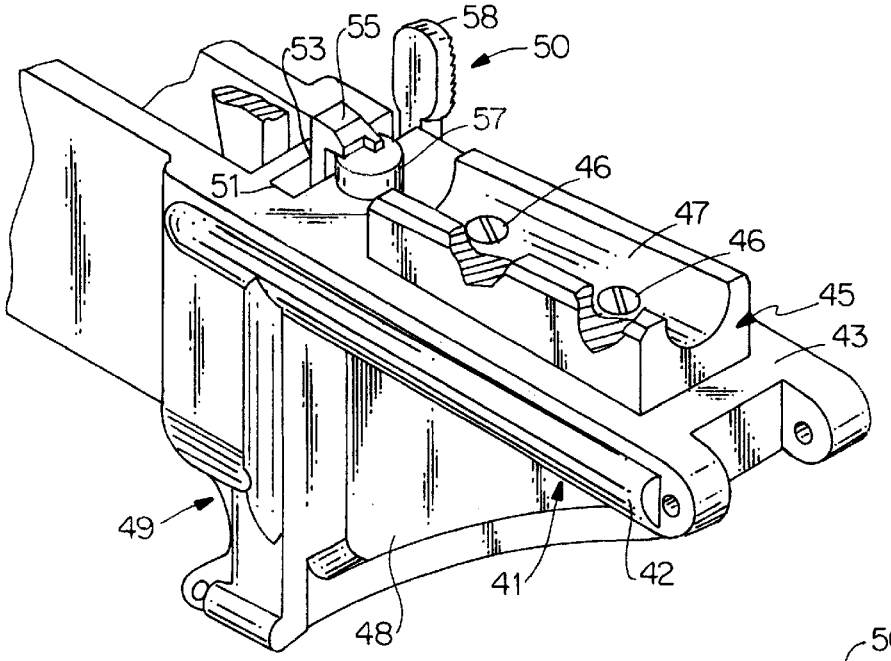
FIG. 4 is a partial perspective view of the modified weapon.
Figure 5:
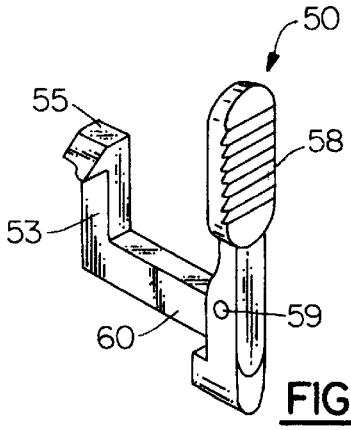
FIG. 5 is an enlarged perspective view of the bolt catch utilized in the present invention.

A bolt catch 50, as best illustrated in FIG. 5, is mounted inside a well 51 formed in the back of the nose section of the lower receiver section. The catch includes a raised arm 53 having a hook like appendage 55 at its distal end which, as shown clearly in FIG. 4, is arranged to overlie the top of a plunger 57 that is slidably contained in a vertically disposed hole formed in the-lower receiver immediately behind the loading block. The bolt catch further includes a thumb actuated lever 58 that is pivotally mounted upon a pivot pin 59 (FIG. 3) on one side of the lower receiver as illustrated in FIG. 3. The thumb lever is attached to the proximal end of the raised arm 53 by means of a connecting bar 60. Depressing the thumb lever will cause the raised arm to rock downwardly against the plunger thereby depressing the plunger.

The bolt is provided with a groove that extends axially along the bottom of the bolt. In assembly, the top of the bolt catch 55 rides in the groove of the bolt. As illustrated in FIG. 2, the plunger 57 is slidably contained within a hole 61 formed in the lower receiver section and is urged upwardly by a spring 63 into biasing contact with the bar 60. When the bolt is in a closed or firing position, the bolt catch is forced downwardly depressing the plunger against the spring action. Once a cartridge is fired, the bolt is forced back by the gases generated during firing against the holding action of the buffer spring until the top of the catch arm is cleared by the bolt whereupon the arm is raised by the plunger to prevent the bolt from moving forward. The spent shell is ejected through the ejection port during the retraction of the bolt in a manner that is well known in the art and need not be explained herein in further detail.

At this time, the ejection port is clear and a new cartridge can be loaded upon the loading block. The bolt is released by depressing the thumb lever which moves the catch arm downwardly a sufficient distance to allow the bolt to clear the catch. The released bolt is moved forward under the influence of the battery spring to engage the cartridge and drives it forward into the firing chamber of the rifle barrel thereby closing the chamber and placing the firing pin in a condition to fire the chambered round once the trigger is pulled back.

As should now be evident, the bolt catch and spring loaded plunger assembly has replaced the magazine finction of the automatic weapon. The present lower receiver section can be easily and rapidly retrofitted to most existing semi-automatic weapons or can be made a permanent part of the original equipment without any substantial increase in cost. Any attempt to alter a weapon not equipped with a magazine well would be extremely difficult and costly.

As best illustrated in FIG. 4, the lower receiver section is cast or otherwise formed so that the nose section 41 provides a relatively thin platform 42 upon which the loading block is supported. A thin vertical rib 48 is located beneath the platform which is joined integrally to the main body 49 of the lower receiver. Accordingly, the present nose section, because of its construction does not allow sufficient material to effectively remove the bolt latch and loading block and machine a magazine well needed to reconvert the weapon to a semiautomatic weapon. Preferably, the thickness of the platform should be one-half inch or less to make machining of this section difficult.

Figure 6:
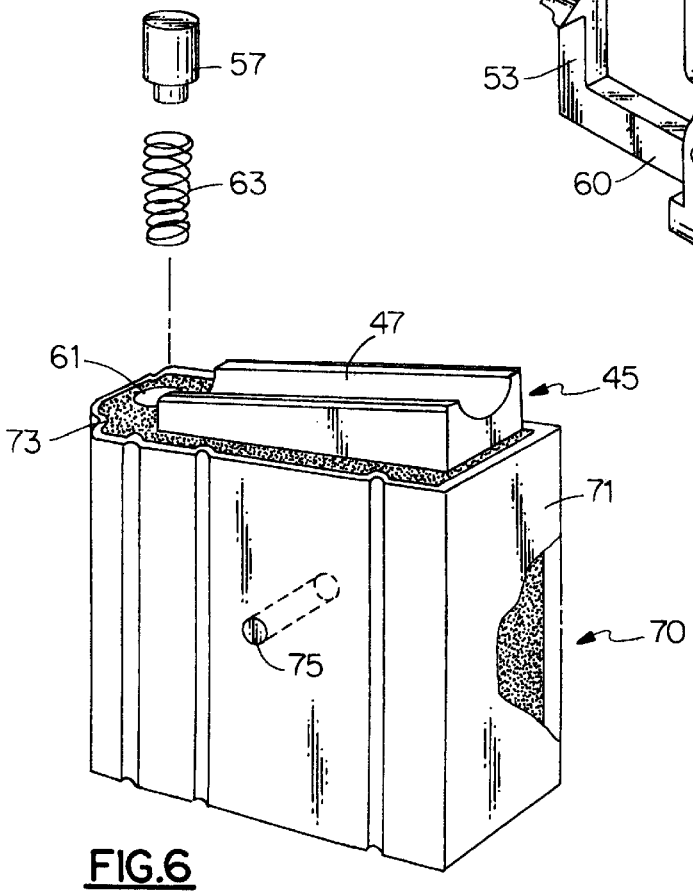
FIG. 6 is a further embodiment of the present invention for modifying a semi-automatic weapon that is equipped with a detachable magazine.

FIG. 6 illustrates a further embodiment of the present invention that is simpler and more cost effective than that described above. A dummy magazine 70 is created from an existing detachable magazine that has been stripped of its internal workings. The shell chamber 71 is filled with a fill material 73 such as a potting material that extends to the top rim of the magazine. A mounting block 45 of the type described above is removably mounted upon the top of the potting material by means of countersunk screws. A hole 61 is formed in the potting material immediately behind the mounting block and a spring 63 and a plunger 57 are slidably mounted in the hole. In assembly, the magazine is mounted within the magazine well of the weapon and is permanently secured in position by at least one rivet 75 that is passed through the side walls of the magazine well. Alternately the magazine can be permanently secured to the well using spot welds or the like formed within appropriate joint regions. When permanently mounted in the well, the plunger will be engaged by the bolt catch and the catch will operate in the manner explained above.

While this invention has been explained with reference to the structure disclosed herein, it is not confined to the details set forth and this invention is intended to cover any modifications and changes as may come within the scope of the following claims:

What is claimed is:

1. A lower replacement receiver for a semi-automatic weapon having a barrel mounted adjacent a receiver and a chamber in said barrel into which cartridges located in the receiver can be fed one at a time by a bolt as the bolt moves between a battery position and a firing position and a removable lower receiver section containing a magazine well said lower replacement receiver further including:

a body having attaching means for securing the replacement receiver to said weapon, said body further including a forward section that is positioned behind the barrel chamber adjacent the ejection port, a loading block mounted upon the top of said forward section so that said loading block is accessible through said ejection port, a piston mounted in the body behind the loading block so that said piston can reciprocate in a vertical direction, a spring acting upon said piston to urge the piston in an upward direction, a bolt catch resting upon said piston that rides in a groove formed in said bolt so that the bolt catch is moved upwardly by said piston when the bolt moves back into a battery position to retain the bolt in the battery position, and release means for manually depressing said bolt catch against the piston to permit the bolt to move from said battery position into a firing position whereby a cartridge on the said loading block is loaded into said chamber.

2. The apparatus of claim 1 wherein said loading block is formed of a lubricious material and said seat is a concave cradle formed along the top surface of the block that is aligned with the axis of the barrel and which is inclined upwardly at a shallow angle whereby a cartridge mounted in the cradle is moved smoothly by the bolt into the rifle chamber when the bolt closes.

3. The apparatus of claim 1 wherein said loading block is removably secured to the body by fastener means.

4. The apparatus of claim 1 wherein said spring is a compression spring that is mounted in said hole beneath said piston.

5. The apparatus of claim 1 wherein the forward section of the body contains a thin platform for supporting the loading block and the piston, said platform having a thickness of one-half inch or less.

6. Apparatus for converting a semi-automatic weapon containing a magazine well into a single shot weapon that includes a dummy magazine that is mounted within the magazine well of the weapon, said dummy magazine containing a fill material having a top surface extending along the top rim of the magazine, a loading block mounted upon the top surface of the fill material, said loading block containing a seat upon which a cartridge can be mounted through the ejection port of the weapon, a piston slidably mounted within a vertical hole formed in the fill material behind the loading block, a compression spring mounted beneath the piston in said hole for biasing the piston upwardly, said piston being located in said magazine to engage the weapon bolt catch to urge the catch upwardly into a bolt retaining position when said bolt is in a battery position, and means to permanently secure the dummy magazine to the magazine well of the weapon so that the dummy magazine cannot be removed from the weapon.

7. The apparatus of claim 6 wherein said dummy magazine is secured to the magazine well of the weapon by rivet means.

8. The apparatus of claim 6 wherein said dummy magazine is secured to the magazine well of the weapon by weld means.

9. The apparatus of claim 6 wherein said dummy magazine is filled with a potting material.

* * * * *